US006972116B2

(12) United States Patent
Brill et al.

(10) Patent No.: US 6,972,116 B2
(45) Date of Patent: Dec. 6, 2005

(54) DEVICE FOR PRODUCING ELECTRICAL DISCHARGES IN AN AQUEOUS MEDIUM

(75) Inventors: Norbert Brill, Constance (DE); Rüdiger Bolze, Reichenau (DE); Stefan Regenscheit, Kreuzlingen (CH); Frank Schock, Constance (DE); Erwin Simnacher, Reichenau (DE); Karl-Heinz Restle, Kreuzlingen (CH)

(73) Assignee: HMT Holding AG, Lengwil (CH)

( * ) Notice: Subject to any disclaimer, the term of this patent is extended or adjusted under 35 U.S.C. 154(b) by 42 days.

(21) Appl. No.: 10/099,876

(22) Filed: Mar. 15, 2002

(65) Prior Publication Data

US 2002/0139687 A1 Oct. 3, 2002

(30) Foreign Application Priority Data

Mar. 15, 2001 (DE) ..... 101 12 461

(51) Int. Cl.[7] ..... B01J 19/08
(52) U.S. Cl. ..... 422/186.04
(58) Field of Search ..... 148/425, 422, 148/423, 426, 427; 422/186.04; 420/442, 420/441, 424, 428, 435, 122, 126, 127, 34, 420/43

(56) References Cited

U.S. PATENT DOCUMENTS 4,081,710 A * 3/1978 Heywood et al. ..... 313/141
4,844,747 A * 7/1989 Jachowski et al. ..... 148/522
6,200,440 B1 * 3/2001 Moran et al. ..... 204/290.01

FOREIGN PATENT DOCUMENTS

DE 3519163 12/1986 ..... H01T 1/24
WO W/O 92/16039 9/1992 ..... H01T 1/24

* cited by examiner

*Primary Examiner*—Steven Versteeg
(74) *Attorney, Agent, or Firm*—O'Shea, Getz & Kosakowski, P.C.

(57) ABSTRACT

A device for producing electrical discharges in an aqueous medium which comprises a first electrode and a second electrode comprised of a superalloy having a cobalt content of greater than 8% by weight or optionally a nickel content of greater than 8% by weight. A high electrical voltage is applied to the electrodes to produce a voltage discharge into the medium that creates a pressure wave in the medium. The electrodes of the device exhibit high thermal shock resistance during discharge thereby reducing tip burnout.

14 Claims, 1 Drawing Sheet

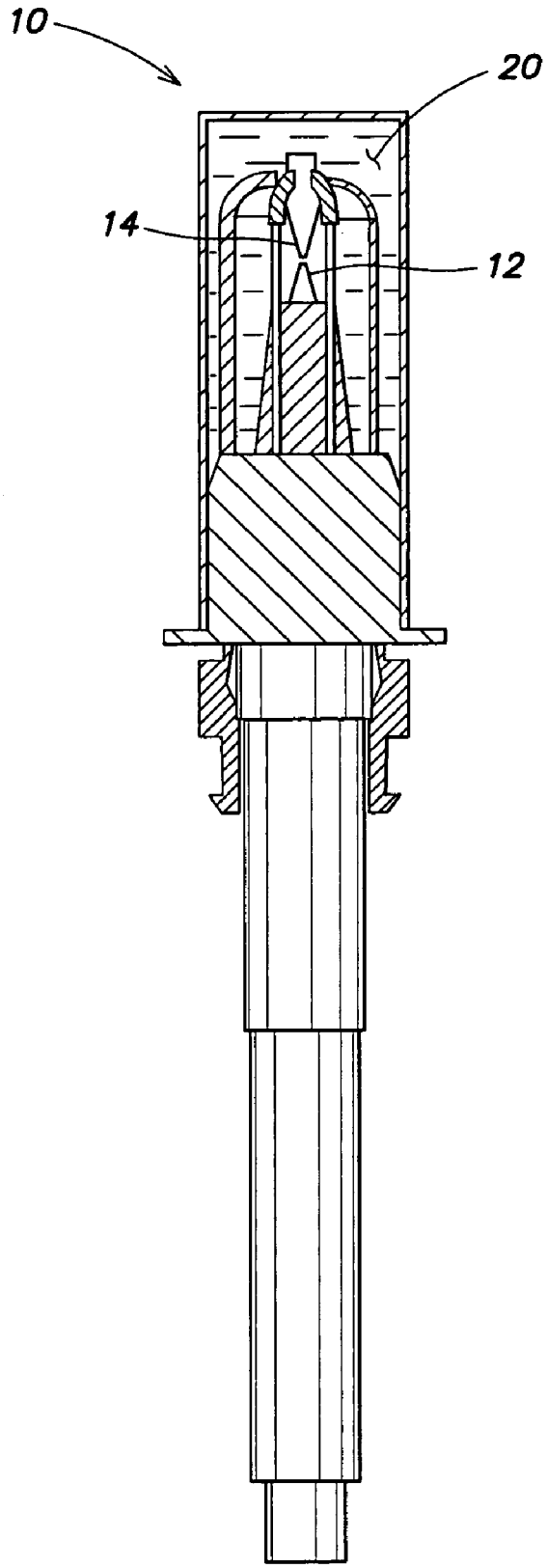
10
20
14
12

DEVICE FOR PRODUCING ELECTRICAL DISCHARGES IN AN AQUEOUS MEDIUM

BACKGROUND OF THE INVENTION

The invention relates to devices for producing electrical discharges in an aqueous medium and more particularly to devices for producing electrical discharges in an aqueous medium comprised of metallic electrodes that exhibit high thermal shock resistance during voltage discharges of the devices.

Electrohydraulic shock waves are increasingly used in medicine for diagnosis, and especially for therapy. The most frequent application is the breakup of bodily concretions (e.g., kidney stones) by extracorporeally produced shock waves. Extracorporeally produced shock waves are being used increasingly for treating orthopedic diseases and for treating pain. Studies are also being conducted in the treatment of tumors and heart diseases.

In the electrohydraulic production of shock waves, a high electrical voltage is applied between the tips of two electrodes, which are in a liquid medium. A voltage breakdown occurs between the tips causing a discharge. As a consequence, a plasma bubble is produced which expands explosively and produces a pressure shock wave. This shock wave is coupled to the body of the patient, with the shock waves being focused on a target area to be treated, in most cases.

Since the electrodes are connected to a voltage and must carry the discharge current, an electrically conducting metallic material is used for the electrodes. The electrodes have been made of steel no. 1.2000–1.3000, which has a good workability for making the tip configuration.

Under the considerable load imposed by the plasma produced during the discharge and the pressure wave, material is removed from the tips of the electrodes. This so-called electrode burnout poses a considerable problem. The material burned out contaminates the aqueous medium in the vicinity of the electrodes and has a disadvantageous effect on the discharge behavior. In many known versions, the aqueous medium is circulated to filter out the burnt material and the gas bubbles produced during their discharge from the aqueous medium. The burnt particles can also have a harmful effect on the valves and the fluid conducting system. In addition, the burning out changes the shape of the electrode tips and the space between the tips increases. This increase in tip distance finally leads to a situation in which discharges no longer take place. It is known that the electrodes can be adjusted mechanically to compensate for the increase in distance between the tips caused by the burning. This adjustment of the electrodes is mechanically difficult. Since, as a rule, only one of the electrodes is adjusted, the location of the current discharges change so that the shock wave production and focusing loses its adjustment.

Another problem consists of the corrosion of the electrodes in the aqueous medium. This corrosion is partially increased by the fact that the aqueous medium has salts added to it in order to improve conductivity and facilitate the electrical discharge. Corrosion of the electrodes allows only short storage times for the device. It is known that storability can be improved by surface-coating the electrodes, for example nickel-plating or lacquer coating. This coating protects the electrode material against corrosion during storage. If, however, the electrode is used, the surface coating is destroyed during the first discharges by burnout and can no longer serve as corrosion protection. Storability of the electrodes after the first use is therefore not provided by such a protective coating. In addition, the material of the coating which enters the aqueous medium in the vicinity of the electrode tips during the discharge can affect the conductivity of the material in an uncontrolled fashion. In this way, the operation of the device becomes unreliable.

Therefore there is need for a device for producing electrical discharges in an aqueous medium, especially for the electrohydraulic production of shock waves, which ensures better storability and longer service life.

SUMMARY OF THE INVENTION

Briefly, according to an aspect of the invention, a device producing electrical discharges in an aqueous medium is provided. The device comprises a first electrode and a second electrode. Each of the electrodes comprises a superalloy having a cobalt content of greater than 8% by weight or optionally a nickel content of greater than 8% by weight. The device produces a voltage discharge into the medium when a high electrical voltage is applied to the electrodes. The voltage discharge creates a pressure wave in the medium. In one aspect of the invention, each electrode comprises superalloy having a cobalt and a nickel content of greater than 12% by weight.

In yet another aspect of the invention, each electrode of the device comprises a thermal-worked steel having a vanadium content of greater than 0.05% by weight and a chromium content of greater than 1% by weight.

In yet a further aspect of the invention, each electrode of the device comprises a stainless steel having a chromium content of greater than 12.5% by weight.

The superalloys, thermal-worked steels and stainless steels have mechanical workability and electrical conductivity suitable for use as an electrode, exhibit high resistance to corrosion thereby improving the storability of the device and exhibit high thermal shock resistance so that the tips of the electrodes better withstand the high thermal and mechanical stresses during the discharge thereby showing less burnout. These properties are equivalent to a high scaling resistance, a high melting point, high specific heat, high heat strength, high thermal conductivity, and a low thermal expansion coefficient. Based on these properties, the superalloys, thermal-worked steels and stainless steels melt at the high temperature of the plasma produced during the discharge only in a very thin surface layer, and the molten layer has sufficiently high adhesion to the tips of the electrodes that the molten layer is not pulled away from the tip by the pressure wave of the discharge and can then solidify on the tip again. This thermal shock resistance reduces electrode tip burnout so that the service life of the device is considerably increased, i.e. the number of discharges that can be produced until the electrodes and the device need to be renewed is increased.

The high corrosion resistance of the material allows not only a very long storage life for the unused electrodes, but also storage of the device once the electrodes have been used. This is especially important in conjunction with the higher resistance and low electrode burnout. The high thermal shock resistance and the greater stability of the electrodes means that the electrodes are not consumed during one use. It is therefore advantageous and necessary for the electrodes to be stored for a long period of time following a first use until they are used for one or more later applications.

These and other objects, features and advantages of the present invention will become more apparent in light of the following detailed description of preferred embodiments thereof, as illustrated in the accompanying drawings.

BRIEF DESCRIPTION OF THE DRAWING

FIGURE is a pictorial illustration of a shock wave generator.

DETAILED DESCRIPTION OF THE INVENTION

The FIGURE shows schematically a device 10 in which two electrodes 12 and 14 are located in an aqueous medium 20. A high electrical voltage is applied to the electrodes 12 and 14 to produce a voltage discharge into the medium 20. The voltage discharge leads to evaporation of the aqueous medium 20 and therefore a pressure wave in this medium 20.

In an embodiment, NE alloys are used for the electrodes 12, 14 as superalloys, which have a cobalt content or a nickel content of at least greater than about 8%. It is especially advantageous that such a superalloy has been found which has a cobalt content and a nickel content of more than about 12.5% each. In particular, the alloy can also be characterized by a tungsten content of about 0.1–15%. Finally, a titanium content of 0.1–5% has proven to be advantageous in these superalloys.

In a second embodiment, the electrodes 12, 14 include a hot-worked steel with a vanadium content of greater than about 0.05% and a chromium content of more than 1% is used as the electrode material. It is especially advantageous to have a vanadium content in the range of between about 0.07–3.5%. The chromium component can be in the range of between about 1 to 15%. In one embodiment, the hot-worked steel has a tungsten component in the range of between about 1–10%.

In a third embodiment, the electrodes 12, 14 comprise a stainless steel with a chromium content of greater than about 12.5%. Advantageously, the chromium content is less than about 30%. Favorable properties result when the stainless steel has a nickel content within the range of between about 2–25%.

The above percentages are to be understood as percentages by weight. In the remaining components not listed, the usual alloy components in these material groups are found.

Although the present invention has been shown and described with respect to several preferred embodiments thereof, various changes, omissions and additions to the form and detail thereof, may be made therein, without departing from the spirit and scope of the invention.

What is claimed is:

1. A device for producing electrical discharges in an aqueous medium, the device comprising:

a first electrode and a second electrode, where each of the electrodes comprises a superalloy having a cobalt content of greater than 8% by weight, the device producing a voltage discharge into the medium when a high electrical voltage is applied to the electrodes, the voltage discharge creating a pressure wave in the medium.

2. The device according to claim 1, where the superalloy has a cobalt and a nickel content of greater than 12% by weight.

3. The device according to claim 1, where the superalloy has a tungsten content of 0.1–15% by weight.

4. The device according to claim 1, where the superalloy has a titanium content of 0.1–5% by weight.

5. A device for producing electrical discharges in an aqueous medium, the device comprising: a first electrode and a second electrode, where each of the electrodes comprises a superalloy having a nickel content of greater than 8% by weight, the device producing a voltage discharge into the medium when a high electrical voltage is applied to the electrodes, the voltage discharge creating a pressure wave in the medium.

6. The device according to claim 5, where the superalloy has a tungsten content of 0.1–15% by weight.

7. The device according to claim 5, where the superalloy has a titanium content of 0.1–5% by weight.

8. A device for producing electrical discharges in an aqueous medium, the device comprising: a first electrode and a second electrode, where each of the electrodes comprises thermal-worked steel having a vanadium content of greater than 0.05% by weight and a chromium content of greater than 1% by weight, the device producing a voltage discharge into the medium when a high electrical voltage is applied to the electrodes, the voltage discharge creating a pressure wave in the medium.

9. The device according to claim 8, where the thermal-worked steel has a vanadium content of 0.07–3.5% by weight.

10. The device according to claim 8, where the thermal-worked steel has a chromium content of 1–15% by weight.

11. The device according to claim 8, where the thermal-worked steel has a tungsten content of 1–10% by weight.

12. A device for producing electrical discharges in an aqueous medium, the device comprising: a first electrode and a second electrode, where each of the electrodes comprises stainless steel having a chromium content of greater than 12.5% by weight, the device producing a voltage discharge into the medium when a high electrical voltage is applied to the electrodes, the voltage discharge creating a pressure wave in the medium.

13. The device according to claim 12, where the stainless steel has a chromium content of less than 30% by weight.

14. The device according to claim 12, where the stainless steel has nickel component of 2–25% by weight.

* * * * *

US006972116C1

(12) INTER PARTES REEXAMINATION CERTIFICATE (789th)

United States Patent
Brill et al.

(10) Number: US 6,972,116 C1
(45) Certificate Issued: Jan. 9, 2014

(54) DEVICE FOR PRODUCING ELECTRICAL DISCHARGES IN AN AQUEOUS MEDIUM

(75) Inventors: Norbert Brill, Constance (DE); Rüdiger Bolze, Reichenau (DE); Stefan Regenscheit, Kreuzlingen (CH); Frank Schock, Constance (DE); Erwin Simnacher, Reichenau (DE); Karl-Heinz Restle, Kreuzlingen (CH)

(73) Assignee: Healthtronics, Inc., Austin, TX (US)

Reexamination Request:
No. 95/001,321, Mar. 23, 2010

Reexamination Certificate for:

| | |
|---|---|
| Patent No.: | **6,972,116** |
| Issued: | **Dec. 6, 2005** |
| Appl. No.: | **10/099,876** |
| Filed: | **Mar. 15, 2002** |

(30) Foreign Application Priority Data

Mar. 15, 2001 (DE) ..... 101 12 461

(51) Int. Cl.

| | |
|---|---|
| ***B01J 19/08*** | (2006.01) |
| ***C22C 38/22*** | (2006.01) |
| ***C22C 38/40*** | (2006.01) |
| ***C22C 38/24*** | (2006.01) |

(52) U.S. Cl.
CPC ..... *C22C 38/22* (2013.01); *C22C 38/40* (2013.01); *C22C 38/24* (2013.01)
USPC ..... 422/186.04

(58) Field of Classification Search
None
See application file for complete search history.

(56) References Cited

To view the complete listing of prior art documents cited during the proceeding for Reexamination Control Number 95/001,321, please refer to the USPTO's public Patent Application Information Retrieval (PAIR) system under the Display References tab.

*Primary Examiner* — Krisanne Jastrzab

(57) ABSTRACT

A device for producing electrical discharges in an aqueous medium which comprises a first electrode and a second electrode comprised of a superalloy having a cobalt content of greater than 8% by weight or optionally a nickel content of greater than 8% by weight. A high electrical voltage is applied to the electrodes to produce a voltage discharge into the medium that creates a pressure wave in the medium. The electrodes of the device exhibit high thermal shock resistance during discharge thereby reducing tip burnout.

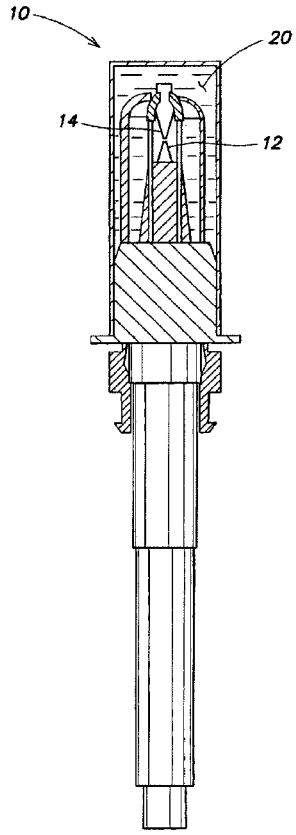

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-14 is confirmed.

New claims 15-26 are added and determined to be patentable.

*15. The device according claim 1, wherein said device is configured to break up bodily concretions.*

*16. The device according to claim 15, wherein said device is an extracorporeal device.*

*17. The device according to claim 16, wherein said first and second electrodes are encapsulated.*

*18. The device according to claim 5, wherein said device is configured to break up bodily concretions.*

*19. The device according to claim 18, wherein said device is an extracorporeal device.*

*20. The device according to claim 19, wherein said first and second electrodes are encapsulated.*

*21. The device according to claim 8, wherein said device is configured to break up bodily concretions.*

*22. The device according to claim 21, wherein said device is an extracorporeal device.*

*23. The device according to claim 22, wherein said first and second electrodes are encapsulated.*

*24. The device according to claim 12, wherein said device is configured to break up bodily concretions.*

*25. The device according to claim 24, wherein said device is an extracorporeal device.*

*26. The device according to claim 25, wherein said first and second electrodes are encapsulated.*

* * * * *